US005451930A

United States Patent [19]

McDaniel

[11] Patent Number: 5,451,930

[45] Date of Patent: * Sep. 19, 1995

[54] EMERGENCY CONDITION, DOOR AJAR, AND TEMPERATURE ALARM FOR APPLIANCES

[76] Inventor: Steven M. McDaniel, 3307 Stoney Mist, San Antonio, Tex. 78247

[ * ] Notice: The portion of the term of this patent subsequent to Feb. 22, 2011 has been disclaimed.

[21] Appl. No.: 199,095

[22] Filed: Feb. 22, 1994

Related U.S. Application Data

[63] Continuation-in-part of Ser. No. 920,827, Jul. 27, 1992, Pat. No. 5,289,162.

[51] Int. Cl.[6] ..... G08B 21/00; G08B 19/00

[52] U.S. Cl. ..... 340/521; 340/540; 340/545; 340/573; 340/815.69; 340/585

[58] Field of Search ..... 340/540, 545, 573, 521, 340/585, 691, 815.67, 815.69

[56] References Cited

U.S. PATENT DOCUMENTS

| | | | |
|---|---|---|---|
| 4,028,688 | 6/1977 | Goleman | 340/585 |
| 4,074,244 | 2/1978 | Balderson | 340/815.69 |
| 4,367,461 | 1/1983 | Gauchard | 340/573 |
| 4,528,558 | 7/1985 | Steers et al. | 340/686 |
| 4,566,285 | 1/1986 | Tershak et al. | 62/129 |
| 4,691,195 | 8/1987 | Sigelman et al. | 340/545 |
| 4,707,684 | 11/1987 | Janke et al. | 340/530 |
| 4,855,721 | 8/1989 | Hallett et al. | 340/585 |
| 4,891,626 | 1/1990 | Neuman | 340/547 |
| 4,894,643 | 1/1990 | Thompson et al. | 340/593 |
| 5,289,162 | 2/1994 | McDaniel | 340/521 |

*Primary Examiner*—Glen Swann, III

*Attorney, Agent, or Firm*—Gunn, Lee & Miller

[57] ABSTRACT

A combination appliance door ajar, occupant emergency and abnormal temperature condition alarm system, in a single unit utilizing three visual indicators, one for each of the emergency conditions, and an audio alarm with multi-tone operation, for each of the emergency conditions. The alarm system incorporates a first light indicator and audio alarm that are triggered in response to a door ajar condition. The time period before the alarm is triggered may be adjusted by means of timer circuitry. The alarm system also incorporates a manually operated switch installed on the interior of the appliance that allows an occupant of the appliance to indicate an emergency condition that requires outside assistance. The occupant emergency system uses a visual indicator and an audible alarm signal that are distinctive from those used for the door ajar system. The alarm system further incorporates a temperature sensor installed on the interior of the appliance for conveying the existence of an emergency temperature condition. The temperature alarm system uses a visual indicator and an audible alarm signal that are distinct from those used for the door ajar and occupant help systems.

8 Claims, 2 Drawing Sheets

EMERGENCY CONDITION, DOOR AJAR, AND TEMPERATURE ALARM FOR APPLIANCES

This is a continuation-in-part of application Ser. No. 07/920,827, filed on Jul. 27, 1992, now U.S. Pat. No. 5,289,162.

BACKGROUND OF THE INVENTION

1. Field of The Invention

The present invention relates generally to contained, environmentally controlled, appliances such as refrigerators and freezers. The present invention relates more specifically to a device for providing an audible and visual alarm when an emergency condition exists within a container appliance, a distinctive audible and visual alarm when the appliance door is ajar for more than a certain period of time, and a distinctive audible and visual alarm when the interior temperature of the appliance deviates from a preselected range.

2. Description of the Related Art

There are generally three critical problems that can occur with large stationary container appliances such as refrigerators and freezers that immediately demand the attention of a person in a position to rectify the problems. The first of these situations occurs when a door to the appliance has been left ajar for a period of time sufficient to affect the stability of the environment within the appliance and the integrity of whatever is being kept within the appliance. A second condition occurs when an individual, either because of the typical latching features of such appliance doors, or because the appliance door becomes blocked from the outside, or because the individual inside is otherwise unable to open the appliance door, becomes trapped within the appliance and runs the risk of prolonged exposure to low temperatures or suffocation due to their inability to exit. The third important condition of concern is an excess deviation of the internal temperature of the appliance from a specified temperature range.

In any of the above referenced situations, it is imperative that someone capable of rectifying the situation is alerted to the condition in time to prevent damage to the appliance and or its contents or to extricate the individual who might have become trapped. While access to large cooling appliances such as freezers and refrigerators is necessary for their efficient use, the maintenance of this access way between the inside and outside of the appliance for anything longer than a very short period of time can greatly increase the expense of operating the appliance.

Likewise, in an effort to adequately seal the apertures through which access is maintained, such appliances are normally manufactured with very tight fitting doors and latch mechanisms that are sometimes operable only from the outside of the appliance. It is also possible that an individual working within the freezer or refrigerator might become injured in a manner that would prevent him from being able to open the door even if it were structured to be opened from the inside. Becoming trapped within the appliance, therefore, creates the immediate concern of exposure or suffocation for the trapped occupant. Unless attention can be called to the situation and someone on the outside of the appliance can open the door, serious injury or death could result.

It is well known in the field to provide an alarm system for indicating when a door to such an appliance has been left open for more than a preselected period of time. The mechanisms for triggering the alarm range from simple time delay circuitry that is initiated when the door is opened and remains opened for a period of time, to separate and isolated thermal devices that sense the temperature within the appliance and trigger an alarm when the temperature increases above some preselected value. Depending upon the requirements of the contents of the appliance and the exchange of heat that results from the opening of the door, the time delay could be anywhere from a few seconds to more than a few minutes. The alarm associated with indicating that the door is ajar is typically a light indicator that turns on steadily or flashes so as to attract attention. It is also known to use audible alarms to indicate that the appliance door is ajar.

For very large refrigerators and freezers such as those used in cold storage warehouses and in grocery store coolers, it is often necessary to enter and exit the appliance for the purpose of storing or removing products from its interior. This process normally requires that one or more individuals enter the appliance and, at times, close the door behind them. While some newer walk-in freezers and refrigerators are constructed with latching mechanisms that can be opened from the interior, a good number of older and even some new freezer and refrigerator units do not anticipate the possibility of an individual being trapped inside. It is, therefore, desirable to have some means whereby an individual who does become trapped inside is capable of notifying those on the outside that they are in need of assistance. Even with the possibility that a door latch could be opened from the inside, the failure of such a latch to open as it is structured to do, would have consequences much more severe than usual because of the conditions within the freezer/refrigerator. The above described situation the occupant is unable to operate the appliance door due to a fall or other injury or because the door is blocked from the outside, also creates a condition with severe consequences.

It is, therefore, desirable, even with an appliance door that may normally be opened from the inside to have a means whereby an occupant of the freezer or refrigerator can signal the outside if the door latch means fails or for some other reason they are unable to open the appliance door.

Finally, it is important to have a means for alerting operators of large or small refrigerator/freezer appliances of abnormal and/or out of range temperature conditions within the appliance. These abnormal temperature conditions could be associated with a door ajar condition or may be associated with the failure of some element of the cooling system for the appliance.

These situations, therefore, are the most common and the most serious conditions for which an alarm or other indicator means is appropriate during the operation of a freezer/refrigerator unit. While alarms of either the audio type or visual type are known for each of these situations, the devices previously described suffer from a number of limitations. Very often, the alarm systems are so complex and expensive to implement that they require significant initial costs for installation or significant maintenance costs or both. It is also typical to have to install separate alarm systems for each of the indicated situations that often results in increased costs and some duplication of effort.

It would be advantageous, therefore, to have a single alarm system for refrigerator and freezer appliances that incorporates a system for notifying the operators of the appliance when the door to the appliance is ajar or open for an extended period of time, when there exists a situation within the appliance that requires immediate attention or assistance, and when the temperature within the appliance is critically abnormal.

SUMMARY OF THE INVENTION

It is, therefore, an object of the present invention to provide the combination of a container-type appliance door ajar alarm system, emergency condition alarm system, and temperature alarm system, in a single visual and audible indicator unit.

It is another object of the present invention to provide a means for alerting the operator of a refrigerator or freezer appliance to a door ajar condition that will detrimentally affect the efficient operation of the appliance.

It is another object of the present invention to provide both a visual and an audible alarm indicator means to alert the operator of an appliance to a door ajar condition that will detrimentally affect the efficient operation of the appliance.

It is another object of the present invention to provide a means for assisting the energy management and conservation of an appliance by providing a means for minimizing thermal losses from the interior of cooling appliances.

It is another object of the present invention to provide both a visual and an audible alarm indicator means to alert the operator of an appliance to a condition within the appliance that requires immediate outside assistance.

It is another object of the present invention to provide both a visual and an audible alarm indicator means to alert the operator of an appliance to an abnormal temperature condition within the appliance.

It is another object of the present invention to provide the combination of a door ajar alarm indicator means, an emergency condition indicator means, and a temperature alarm means, within a single unit that allows the observer or individual hearing the alarms to distinguish each of the emergency situations.

It is another object of the present invention to provide both a visual and an audible alarm indicator means for an appliance door ajar condition, an occupant emergency condition, and an abnormal temperature condition, that allows the appliance operator to hear and/or see the alarm and to distinguish between each of the emergency conditions, and to provide such a combination of alarm systems at low cost and in a low profile enclosure.

In fulfillment of these and other objectives, the present invention provides the combination of a freezer/refrigerator appliance door ajar alarm indicating system, an appliance occupant emergency condition indicating system, and an abnormal temperature indicating system, in a single unit that utilizes a number of visual indicator means, one for each of the emergency conditions, and an audible alarm means of multi-tone operation, one tone for each of the emergency conditions indicated. The present invention incorporates a first light indicator means in conjunction with an audible alarm means that is triggered in response to a door ajar condition switch's being opened for longer than a preset period of time. The time period before the alarm is triggered may be adjusted by means of a timer circuitry and may be determined by the appliance operator.

The present invention also incorporates a manually operated switch installed on the interior of the appliance that allows an occupant of the appliance to indicate to those on the outside the existence of an emergency condition that requires assistance. This second alarm system also incorporates a visual indicator means in the form of a second light attached near, but distinctive from the visual alarm indicator for the door ajar condition. Likewise, the emergency condition alarm system incorporates a trigger to the audio circuitry that initiates the emission of an audible alarm signal of a tone distinct from that initiated for the door ajar system. There is no timer delay circuitry incorporated into the emergency condition system.

The present invention also incorporates a temperature sensor installed on the interior of the appliance that triggers alarm circuitry when the interior temperature of the appliance deviates from a selected range. This third alarm system also incorporates a visual indicator means in the form of a third light attached near, but distinctive from the visual alarm indicators for the other critical conditions. Likewise, the abnormal temperature condition alarm system incorporates a trigger to the audio circuitry that initiates the emission of an audible alarm signal of a tone distinct from that initiated for the other systems. There is a timer delay circuitry incorporated into the abnormal temperature condition system, as well as a means for resetting the audible alarm.

The present invention provides each of these alarm systems in a single unit that is both low in cost and low in physical profile. The present invention incorporates a large speaker unit with associated audio electronics mounted in a position adjacent the door of the appliance with a first light indicator means on one side of the speaker unit, a second light indicator means on an opposite side of the speaker unit, and a third light unit on a top side of the speaker unit. A door switch is connected to the electronics of the alarm unit and an occupant emergency condition connection is made from a manually operated switch within the appliance to the electronic circuitry of the alarm device. The temperature sensor is positioned within the appliance at a representative location. Optionally the system includes a connection to a fan/solenoid relay that operates an appliance fan when the critical conditions dictate such and a security temperature alarm relay that is not subject to being reset.

These and other objects of the present invention will become apparent from a review of the detailed description of the preferred embodiments and the appended claims.

DETAILED DESCRIPTION OF THE PREFERRED EMBODIMENT

Figure 1:
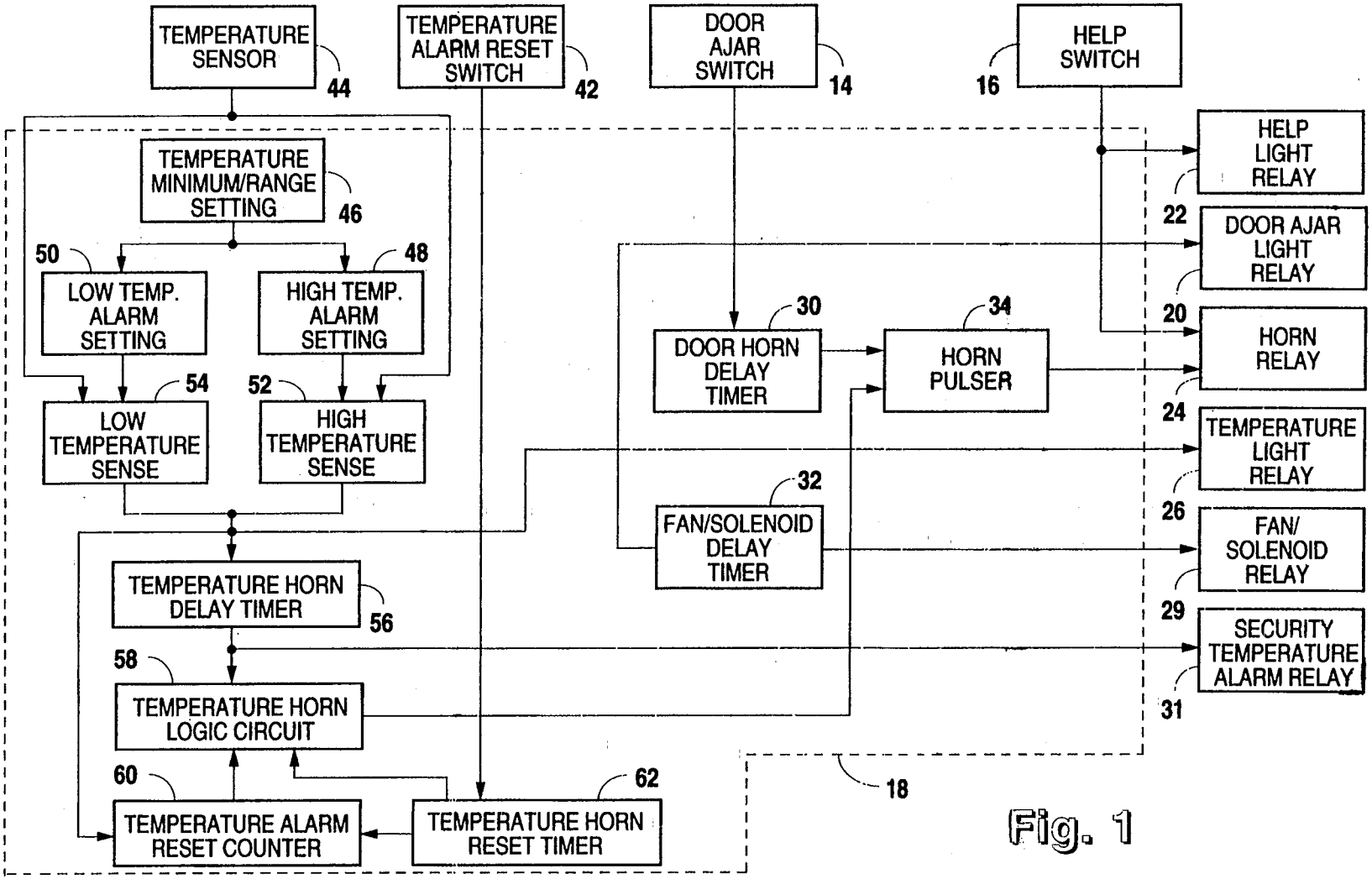
FIG. 1 is a block diagram showing the various components of the apparatus of the preferred embodiment of the present invention.

Reference is made to FIG. 1 for a detailed description of the overall system and the various components that together make up the alarm apparatus of the present invention. The combination alarm unit is enclosed in a single cabinet enclosure and is connected to a number of external devices either attached to the cabinet enclosure or incorporated in the appliance. Preferably, the alarm unit would be mounted in a central, highly-visible position, typically above the door of the appliance of concern. An external power supply (not shown) provides the necessary electrical power to both the electronic circuitry of the alarm unit and the audio and visual indicators (described below) that are incorporated into the unit.

The alarm unit of the present invention is comprised primarily of electronic control circuitry (18) that connects to and operates a number of indicator relays that themselves control the various alarm indicators as described in more detail below. Electronic control circuitry (18) receives input from help switch (16), door ajar switch (14), temperature alarm reset switch (42), and temperature sensor (44). Electronic control circuitry (18) thereafter controls door ajar light relay (20), help light relay (22), horn relay (24), temperature light relay (26), fan solenoid relay (29), and security temperature alarm relay (31). The indicator relays described are themselves incorporated into the physical cabinet of the alarm unit and convey by electrical connection ah on or off condition to the indicators themselves. As described in more detail with FIGS. 2 and 3, some of the indicators are attached directly to the cabinet of the alarm unit while others are remote from the unit itself.

A power supply (not shown) for the unit may be either a simply AC electrical connection to an available 110 AC, 60 Hz, current source or may be a self-contained DC power supply appropriate for the components for the alarm unit.

A thorough understanding of the specific components of the apparatus of the present invention is perhaps best accomplished by reference to FIG. 1 and a description of the operation of the system under each of the specific alarm conditions. Beginning first with an occupant emergency or help condition, help switch 16 is positioned within the appliance at a location appropriate for access by an individual that may need assistance. Help switch (16) is manually thrown and is normally in a deactivated position when no emergency condition exists. Help switch (16) is connected to electronic control circuitry (18) by a single pair conductor. Activating help switch (16) serves to operate help light relay (22) and to operate horn relay (24). The activation of help light relay (22) illuminates an indicator on the alarm unit cabinet associated with the occupant emergency condition and the activation of horn relay (24) causes the emission of an audible signal from the horn/siren, also associated with an occupant emergency condition. Unlike the other critical condition systems described below, there is no time delay between the activation of help switch (16) and the activation of both help light relay (22) and horn relay (24).

Door ajar switch (14) is normally in a deactivated position when the appliance door is closed and is activated when the appliance door is open. Like help switch (16), door ajar switch (14) is connected to electronic control circuitry (18) by a single pair conductor. Door ajar switch (14) is connected to three circuit elements within electronic control circuitry (18) and causes three immediate events to occur. First, door ajar light relay (20) is activated, thereby illuminating an appropriate door ajar indicator on the alarm unit. Second, door horn delay timer (30) is triggered to initiate a time cycle preset to delay the activation of an audible alarm for the door ajar condition. The purpose of this delay timer (30), and other delay timers described in more detail below, is to prevent the immediate activation of the horn audible signal when, in fact, no true emergency condition exists. For example, opening and closing the appliance door would immediately trip door ajar switch (14) but would not necessarily indicate that the door is remaining open for an abnormal period of time. While it would be appropriate in this situation for door ajar light relay (20) to be triggered and for the door ajar indicator to be illuminated, the audible alarm is appropriate only when the door ajar condition remains for a period of time. This period of time can be set in electronic control circuitry (18) by an appropriate adjustment of the biasing on door horn delay timer (30). Well known circuits associated with integrated devices for implementing this delay time are utilized in the preferred embodiment.

The third action initiated when door ajar switch (14) is activated is the triggering of fan/solenoid delay timer (32). Operating in much the same fashion as door horn delay timer (30), fan/solenoid delay timer (32) prevents the immediate operation of fan/solenoid relay (29) and initiates this corrective action only after door ajar switch (14) remains activated for an abnormal period of time. Fan/solenoid delay timer (32), in the preferred embodiment, is also an appropriately configured integrated circuit with adjustable biasing for changing the fan/solenoid delay time.

After the appropriate time period, as determined by door horn delay timer (30), has passed, horn pulser (34) is activated at a frequency specific for the door ajar condition. This frequency causes horn relay (24) to activate the audible horn device (not shown) and generate a sound that can be associated with the particular door ajar condition. Unlike help switch (16) and the associated relays with an occupant emergency condition, the door ajar condition would be typified by the initial operation of door ajar light relay (20) and the associated illumination of the door ajar indicator followed after a period of time by the initiation of an appropriate audible signal indicating that the door ajar condition has remained for some preset period of time. Also as a result of this door ajar condition remaining for a set period of time, fan/solenoid relay (29) activates the fan units within the appliance system that facilitate corrective action that helps compensate for the door ajar condition.

Temperature sensor (44) provides a voltage indicative of the temperature within the appliance through a standard thermocouple-type transducer and thermocouple electrical connections. Initially, electronic control circuitry (18) is preset by the user for specific high and low temperature alarm settings. In the preferred embodiment of the present invention, the operator initially sets an absolute minimum temperature that the alarm unit is expected to operate at and a temperature range or span over which the unit might be required to operate. This minimum temperature and temperature span values are set by temperature minimum/range setting circuit (46). Thereafter, the operator sets a low and high temperature alarm value within the range, by way of low temperature alarm setting circuit (50) and high temperature alarm setting circuit (48). In each case, these temperature settings are effected by standard variable resistor and/or potentiometer circuit elements. These preset temperature values are then compared to the actual appliance temperature value provided through temperature sensor (44), high temperature sensor circuit (52), and low temperature sensor circuit (54). These temperature sensing circuits (52) and (54) are, in the preferred embodiment, comparator devices that compare the voltages from temperature sensor (44) and the low and high temperature alarm setting circuits (48) and (50). When either a high or low temperature condition exits, an appropriate voltage level is provided to a number of subsequent circuit elements within the unit as described below.

First, this abnormal temperature signal triggers temperature light relay (26) and thereby illuminates the abnormal temperature condition indicator. Second, as with the door ajar condition system, temperature horn delay timer (56) is activated so as to delay the immediate activation of an audible signal associated with an abnormal temperature condition. After a time delay controlled by temperature horn delay timer (56), activation of an audible signal by way of horn relay (24) is made through horn pulser (34) and temperature horn logic circuit (58) (described in more detail below).

The circuitry of the present invention is provided with a mechanism for resetting the temperature alarm circuitry, at least as far as activation of the audible signal is concerned. While the visual abnormal temperature indicator signal occurs whenever an out-of-range temperature is sensed, the circuit allows the operator of the alarm unit to terminate, for a period of time, the audible alarm signal through the activation of temperature alarm reset switch (42). Activating temperature alarm reset switch (42) terminates the activation of horn relay (24) and initiates temperature horn reset timer (62). The deactivation of horn relay (24) is accomplished through temperature alarm reset counter (60) and temperature horn logic circuit (58). Horn logic circuit (58) is simply a sequence of electronic logic gates that allow activation of horn pulser (34) and, therefore, horn relay (24) only under certain conditions. Such electronic logic circuits are well known in the art and are easily configured to permit a signal output (in this case to horn pulser (34)) when the various controlling circuits allow. In the present invention, temperature horn delay timer (56) must initially provide an activation signal to temperature horn logic circuit (58) indicating that an appropriate delay time has passed between the sensing of an abnormal temperature and the activation of horn relay (24). Note that temperature light relay (26) is activated whenever an abnormal temperature is sensed and without the delay associated with the audible signal. As described above, however, temperature alarm reset switch (42) provides a signal state to temperature horn logic circuit (58) that prevents the activation of horn relay (24). This deactivation is maintained for the time period set by temperature horn reset timer (62) and is allowed to occur for a number of resets as determined by temperature alarm reset counter (60). Alarm reset counter (60) is activated by the presence of an abnormal temperature condition and, thereafter, counts the number of resets as initiated by temperature alarm reset switch (42). The operator of the alarm unit may allow the unit to reset an infinite number of times or, in the preferred embodiment, 2, 4, 6, 8, etc., number of resets. This is set by standard biasing of the counter. Temperature horn reset timer (62) signals temperature alarm reset counter (60) that another reset event has been activated (by reset switch 42)) and permits activation of horn pulser (34) by way of temperature horn logic circuit (58). Temperature alarm reset counter (60) prevents subsequent activation of horn pulser (34) when the limit is reached by way of temperature horn logic circuit (58). As indicated above, temperature horn logic circuit (58) is a standard arrangement of logic gates configured to permit a signal output only under certain conditions.

Security temperature alarm relay (31) is an external device that ensures an alarm indication of an abnormal temperature condition, regardless of the reset conditions of the electronic control circuitry (18). Once activated through temperature horn delay timer (56), security temperature alarm relay (31) provides an indication of an abnormal temperature condition that is constant and not tied to the reset circuitry described above. Such a security temperature alarm indicator might be a remote device that would assist in the monitoring of an appliance not frequently being accessed. It is understood that the door ajar condition and the occupant emergency condition would occur only with active use of the appliance, whereas long-term storage of products within the appliance could occur and remote monitoring of the temperature conditions might be required.

Figure 2:
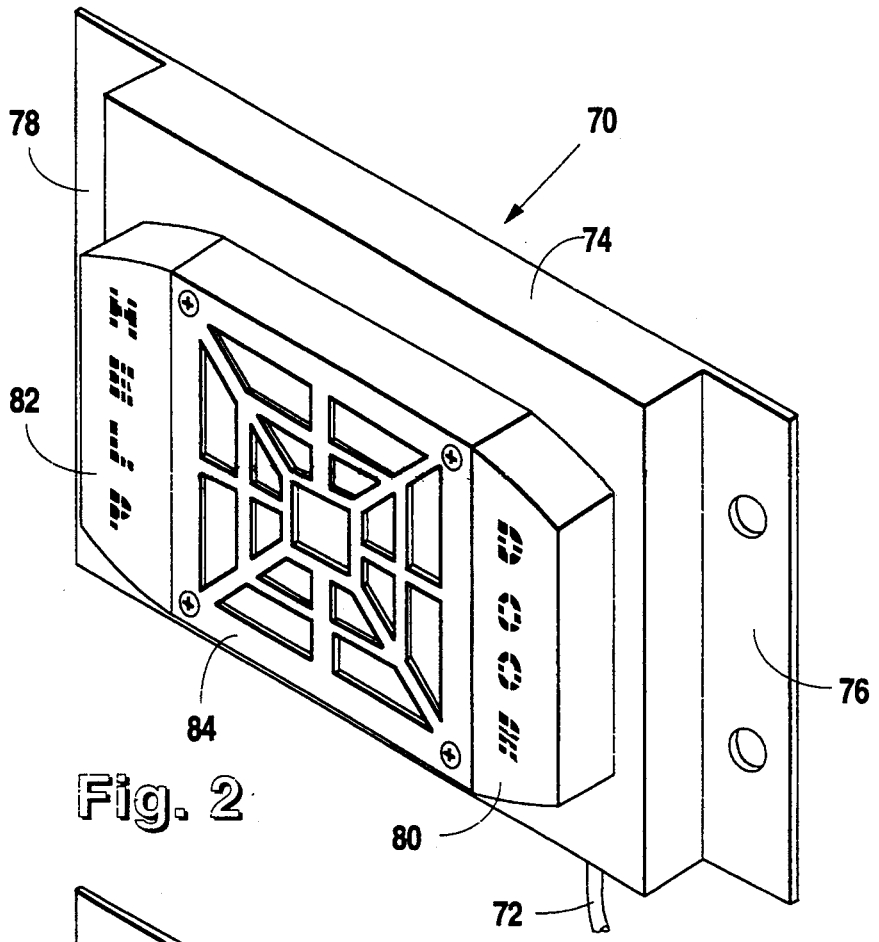
FIG. 2 is a perspective view of the cabinet configuration and the alarm indicator means shown for a first preferred embodiment of the apparatus of the present invention.
Figure 3:
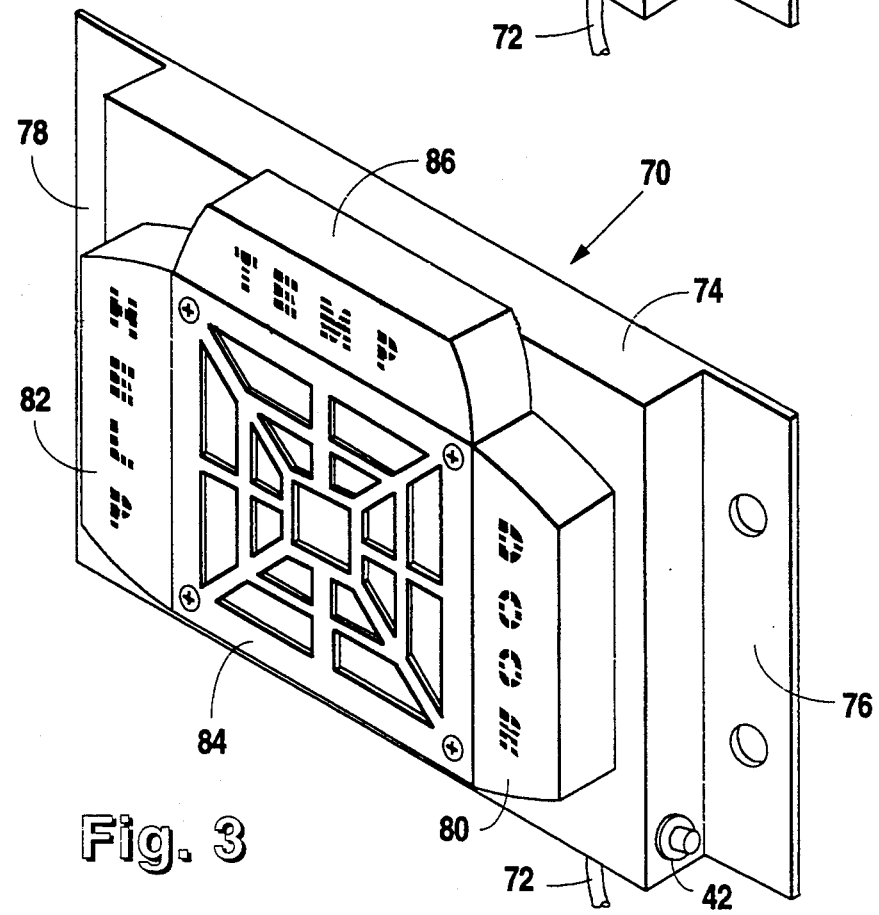
FIG. 3 is a perspective view of the cabinet configuration and the alarm indicator means shown for a second preferred embodiment of the apparatus of the present invention.

Reference is now made to FIGS. 2 and 3 for detailed descriptions of the physical characteristics of the various components of the alarm device of the present invention. It is understood that although the above description of the elements of the preferred embodiment of the present invention incorporates three alarm condition systems and a number of optional external relay systems, any combination of these various elements could be implemented. Alarm units that incorporated one, two, or all three of these critical condition systems could be assembled. FIG. 2 shows the configuration of a first preferred embodiment of the present invention wherein two alarm indicators/systems are utilized, and FIG. 3 shows the configuration of a second preferred embodiment of the present invention wherein three alarm indicators/systems are utilized. It is considered clear from these two representations how a single alarm system might be implemented and how any combination of the various alarm concerns could be structured.

The combination alarm device as shown in both FIGS. 2 and 3 is enclosed in a single cabinet unit (70) of a size determined primarily by the configuration and characteristics of horn/siren speaker (84). Electronic control circuitry (not shown) is sufficiently compact that it may be completely incorporated in enclosure (74) which is of a size large enough to accommodate horn/siren speaker (84). A first (door ajar) indicator (S0) is a light unit attached to one side of horn/siren speaker (84), and a second (occupant help) indicator (82) is a light unit of a similar size and configuration, but is attached to an opposite side of horn/siren speaker (84).

In the preferred embodiment, first (door ajar) indicator (80) comprises a light lens of a distinctive coloration, white for example, while second (occupant help) indicator (82) comprises a light lens of a second distinctive coloration, red for example. In the preferred embodiment as shown in FIG. 2, the distinctiveness of the two visual alarm indicators is further enhanced by providing wording on each light lens such that the uninformed observer of the alarm immediately is aware of the condition that is being indicated.

Although distinctive audible alarms are provided as described above, both audio alarm signals are provided by way of horn/siren unit (84) and, therefore, the speaker of this unit is centrally located between the two visual alarms.

FIG. 3 is identical to FIG. 2 with the addition of third (temperature) indicator (86) and temperature alarm reset switch (92). The structure of third indicator (86) is similar to the indicators shown in FIG. 2, and switch (42) is a momentary push button switch.

As indicated above, electronic control circuitry (18) (not shown in FIG. 2) is fully enclosed within cabinet (70) appropriately sized to house horn/siren (84). Power is provided by way of electrical power/signal cable (72), to electronic control circuitry (18) and in the preferred embodiment is from a typical 110 VAC, 60 Hz, electrical outlet.

The actual installation of the device of the present invention involves mounting the combination alarm cabinet unit in a highly visible position adjacent to the door of the appliance. Typically this means centering the unit above the door portal for the appliance as installation conditions allow. In a preferred embodiment, where the alarm system is incorporated into the body of the appliance prior to the installation of the appliance itself, the conductors connecting door ajar switch, occupant emergency help toggle switch, and the temperature sensor are incorporated within the walls of the appliance itself. In a retrofit situation, electrical connections to These devices can be made either on the exterior surface of the appliance unit or by drilling holes into the interior of the appliance unit and appropriate running the wires therein.

Power supply connections to the combination alarm device are typically run through conduit up to the unit when such power is supplied from a standard 110 VAC source. In some situations where a DC battery operated unit is desired, the battery source for the power to the unit may be mounted immediately adjacent to combination alarm device (10). In either case, it is preferable to enclose the electrical connections between the power supply and combination alarm device within an appropriately sized conduit.

Although the invention has been described with respect to certain specific preferred embodiments, many variations and modifications would become apparent to those skilled in the art, after a review of the disclosure herein and the appended claims. It is the intent that the appended claims be interpreted as broadly as possible in view of the prior art to include all such variations and modifications.

I claim:

1. A combination appliance alarm system for providing indications that a door of the appliance has been left ajar, for indicating an emergency condition within the appliance, and for indicating an out-of-range temperature condition within the appliance, the alarm system comprising:

a door switch means positioned so as to be deactivated when said door of said appliance is closed and to be activated when said door of said appliance is open;

a help switch means, said help switch means positioned within an interior space of said appliance, said help switch capable of being manually toggled from a normally deactivated position to an activated position;

a temperature sensor, said temperature sensor positioned within an interior space of said appliance, said sensor capable of providing an indication of a temperature within said appliance;

a first visual indicator means;

a second visual indicator means;

a third visual indicator means;

an audio indicator means; and electronic control circuitry, said electronic control circuitry capable of detecting a deactivated or activated condition of said door switch means and of said help switch means, receiving said temperature indication, and controlling said first, second, and third visual indicator means, and said audio indicator means in response to said condition of said door switch means, said help switch means, and said temperature.

2. The combination appliance alarm system of claim 1, wherein said first visual indicator means emits light of a first color, said second visual indicator means emits light of a second color, and said third visual indicator means emits light of a third color, said second and third colors being distinct from said first color and from each other.

3. The combination appliance alarm system of claim 1, wherein said electronic control circuitry further comprises:

means for illuminating said first visual indicator means; and means for triggering said audio indicator means;

whereby said first visual indicator means and said audio indicator means are illuminated and triggered respectively by activation of said door switch means.

4. The combination appliance alarm system of claim 3, wherein said electronic control circuitry further comprises timer circuitry capable of delaying said triggering of said audio indicator means a preset period of time from said activation of said first door switch means.

5. The combination appliance alarm system of claim 4, wherein said preset period of time in said timer circuitry is manually adjustable.

6. The combination appliance alarm system of claim 1, wherein said electronic control circuitry further comprises:

means for illuminating said second visual indicator means; and means for triggering said central indicator means;

whereby said second visual indicator means and said audio indicator means are illuminated and triggered respectively by activation of said help switch means.

7. The combination appliance alarm system of claim 1, wherein said electronic control circuitry further comprises:

means for comparing said temperature with a preset temperature range and determining when said temperature is outside of said preset temperature range;

means for illuminating said third visual indicator means; and means for triggering said audio indicator means;

whereby said third visual indicator means and said audio indicator means are illuminated and triggered respectively by said determination that said temperature is outside of said preset temperature range.

8. A combination appliance alarm system for providing indications that a door of the appliance has been left ajar, for indicating an emergency condition within the appliance, and for indicating an out-of-range temperature condition within the appliance, the alarm system comprising:

a door switch means positioned so as to be deactivated when said door of said appliance is closed and to be activated when said door of said appliance is open;

a help switch means, said help switch means positioned within an interior space of said appliance, said help switch capable of being manually toggled from a normally deactivated position to an activated position;

a temperature sensor, said temperature sensor positioned within an interior space of said appliance, said sensor capable of providing an indication of a temperature within said appliance;

a first visual indicator means;

a second visual indicator means;

a third visual indicator means; wherein said first visual indicator means emits light of a first color, said second visual indicator means emits light of a second color, and said third visual indicator means emits light of a third color, said second and third colors being distinct from said first color and from each other;

an audio indicator means; and electronic control circuitry, said electronic control circuitry capable of detecting a deactivated or activated condition of said door switch means and of said help switch means, receiving said temperature indication, and controlling said first, second, and third visual indicator means, and said audio indicator means in response to said condition of said door switch means, said help switch means, and said temperature, said electronic control circuitry further comprising: means for illuminating said first visual indicator means;

first means for triggering said audio indicator means;

whereby said first visual indicator means and said audio indicator means are illuminated and triggered respectively by activation of said door switch means;

timer circuitry capable of delaying said triggering of said audio indicator means a preset period of time from said activation of said door switch means;

means for illuminating said second visual indicator means;

second means for triggering said audio indicator means;

whereby said second visual indicator means and said audio indicator means are illuminated and triggered respectively by activation of said help switch means;

means for comparing said temperature with a preset temperature range and determining when said temperature is outside of said preset temperature range;

means for illuminating said third visual indicator means; and third means for triggering said audio indicator means;

whereby said third visual indicator means and said audio indicator means are illuminated and triggered respectively by said determination that said temperature is outside of said preset temperature range.

* * * * *